United States Patent [19]

Blomberg et al.

[11] 4,362,029

[45] Dec. 7, 1982

[54] ABSORPTION REFRIGERATOR BOILER CONSTRUCTION

[75] Inventors: Peter E. Blomberg, Stockholm; Karl G. Boren, Skärholmen; Axel H. Östergren, Stockholm, all of Sweden

[73] Assignee: Aktiebolaget Electrolux, Stockholm, Sweden

[21] Appl. No.: 251,347

[22] Filed: Apr. 6, 1981

[30] Foreign Application Priority Data

Apr. 15, 1980 [SE] Sweden ..... 8002803

[51] Int. Cl.[3] ..... F25B 33/00

[52] U.S. Cl. ..... 62/497; 62/148

[58] Field of Search ..... 62/148, 490, 491, 493, 62/497, 496

[56] References Cited

U.S. PATENT DOCUMENTS

| | | | |
|---|---|---|---|
| 3,295,334 | 1/1967 | Hultgren | 62/497 X |
| 3,785,171 | 1/1974 | Beranek et al. | 62/490 |
| 3,808,834 | 5/1974 | Eber | 62/490 |
| 3,864,937 | 2/1975 | Asher et al. | 62/497 X |
| 4,137,727 | 2/1979 | Kuhlenschmidt | 62/490 |
| 4,185,470 | 1/1980 | Eber | 62/497 X |

*Primary Examiner*—Lloyd L. King

*Attorney, Agent, or Firm*—Alfred E. Miller

[57] ABSTRACT

A single-pipe boiler construction in an absorption refrigerating apparatus which operates with inert gas, an absorption solution that is rich in refrigerant. The latter is lifted in a central pump pipe in which vapor is expelled and the weak solution thus formed flows downwardly in an outer pipe. At least one heat source is arranged in heat-conductive contact with the outside of the outer pipe and heat from the heat source is conducted through the weak solution in the outer pipe to the pump pipe and its contents. Heat is supplied directly by conduction to the outer pipe and a direct heat-conductive connection is arranged between the outer pipe and the pump pipe.

6 Claims, 2 Drawing Figures

ABSORPTION REFRIGERATOR BOILER CONSTRUCTION

Figures 1, 2:
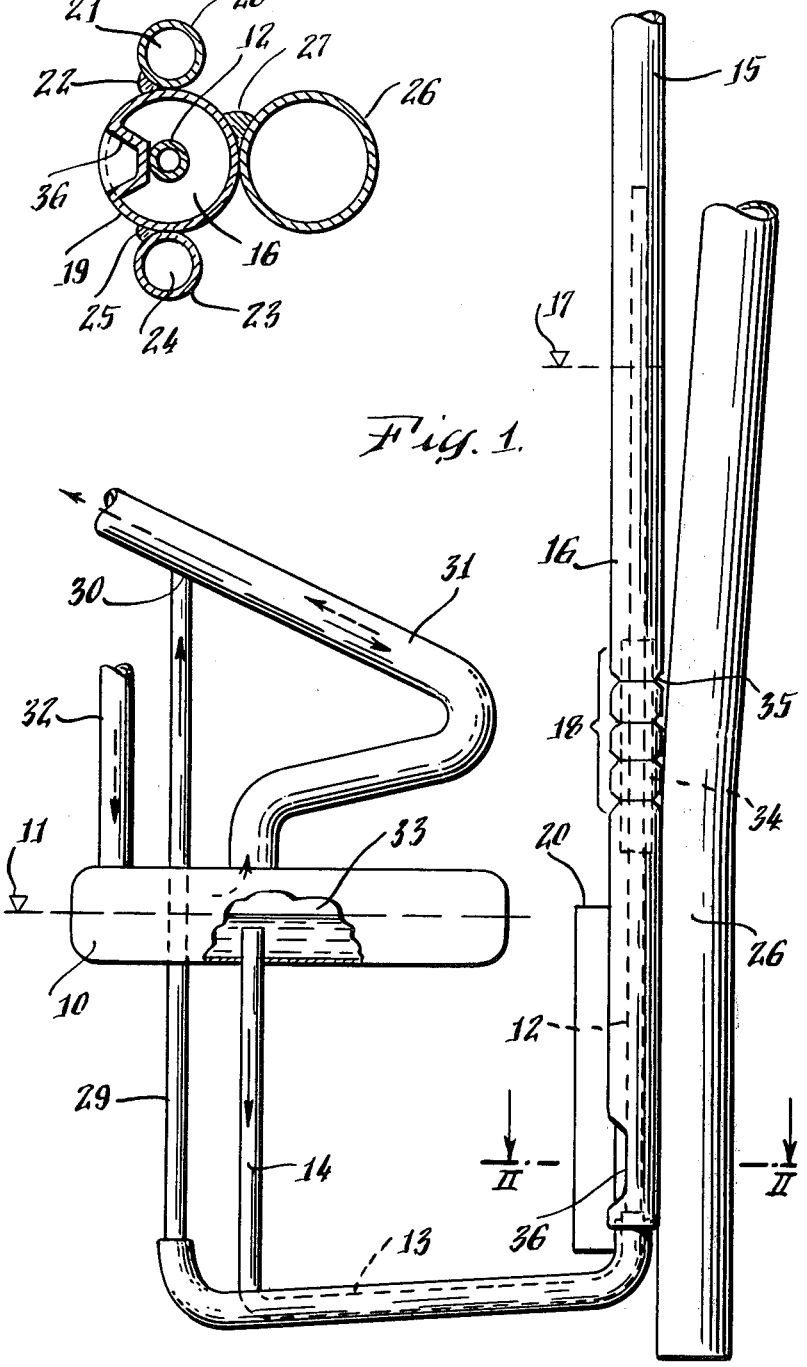

This invention relates to a single-pipe boiler construction in an absorption refrigerating apparatus that operates with inert gas and in which the absorption solution, rich in refrigerant, is lifted in a central pump pipe and vapor is expelled therefrom, and the weak solution thus formed flows downwardly in an outer pipe. At least one heat source is arranged in heat-conductive contact with the outer pipe, and heat from the heat source is conducted through the weak solution in the outer pipe to the pump pipe and its contents.

Upon starting a cold apparatus of this type, the temperature in the boiler rises to a value considerably above the normal temperature of operation upon occasion. This has also been observed when starting an apparatus which has been switched off for some hours.

Such abnormally high boiler temperatures involve the risk that corrosion-protecting components, such as a type of chromates, added to the solution are consumed in a shorter period of time than what is considered to be normal. It has further turned out that the start of the pumping of liquid in the pump pipe does not begin until the temperature of operation in the outer pipe has been surpassed to a considerable extent. In addition to the disadvantageous influence on the cooling capacity of the refrigerating apparatus the above-mentioned disadvantages can negatively affect the life of the apparatus.

The high temperature in the outer pipe and the pump pipe is due to the fact that when the solution in the pump pipe becomes cold it obtains the same concentration as the weak solution outside the pump pipe. In order for the pump to start, the solution in the pump pipe must reach its boiling temperature, which when the solution is weak is about 40° C. above the operating temperature prevailing in the same pipe when rich solution is supplied from the absorber vessel.

A principal object of the present invention is to eliminate the above disadvantages and for this purpose the invention is generally characterized in that heat is supplied directly by conduction to the outer pipe, and in that a direct heat-conductive connection is arranged between the outer pipe and the pump pipe.

The invention will be described below with reference to a boiler with liquid circulation system as shown in the drawing.

In order that the invention will be more clearly understood, it will now be disclosed in greater detail with reference to the accompanying drawings, in which:

FIG. 1 is a diagrammatic elevational view of a part of an absorption refrigerator showing a boiler having a liquid circulation system constructed in accordance with the teachings of the present invention, and FIG. 2 is a horizontal sectional view taken through the lines II—II of FIG. 1.

The drawings show diagrammatically a liquid circulation system in an absorption refrigerating apparatus having a so-called single pipe boiler construction and operating with inert gas and containing water, ammonia and hydrogen gas as working media. It is evident that other types of working media may be utilized in the present refrigerating apparatus, and since the construction and function of other parts of the refrigerating apparatus of this type are well known a description of the liquid circulation system as shown in the drawings is sufficient for a complete understanding of the present invention.

The absorber vessel 10 of the apparatus contains rich absorption solution rising up to a liquid level 11, and when the apparatus is inactive and cold, the liquid is at the same level in a pump pipe 12, communicating by way of an inner pipe 13 in the liquid heat exchanger with the absorber vessel 10. During operation, rich solution flows from the vessel 10 through a conduit 14 and the inner pipe 13 and is pumped through the pump 12 while expelling vapor. The vapor is conducted through a vapor conduit 15 to a condenser (not shown) of the apparatus, whereas the lifted liquid, which is now weak in refrigerant, is collected in an outer pipe 16 surrounding the pump 12. During operation a liquid level 17 is maintained in the outer pipe 16. The liquid flows downwardly through a rectifier 18 and that part of the boiler in which heat is supplied from one of the heat sources of the apparatus. FIG. 2, which is a cross section through this part of the boiler, shows the outer pipe 16 of the boiler in heat-conductive connection to several heat sources, which can be used alternatively. A sleeve 20 for an electric heating cartridge 21 is connected by a weld 22 to the outer pipe 16. In a similar manner another sleeve 23 for an electric heating cartridge 24, for example, for a different operating voltage than the cartridge 21, is also heat-conductively connected to the other pipe 16 by a weld 25. The apparatus can also be operated by a burner for gas or liquid fuel, and in such a case the hot gases are conducted through a flue pipe 26, which by a weld 27 is heat-conductively connected to the pipe 16.

The weak solution in the outer pipe of the boiler is conducted through the liquid heat exchanger and a conduit 29 to an inlet 30 at the top of the absorber 31 of the apparatus. During operation, the liquid level 17 in the boiler part is so much above the inlet 30 in the absorber part that resistance in the flow path can be overcome and a weak solution supplied continuously to the absorber 31.

The weak solution supplied to the absorber 31 flows in counterflow to inert gas, which is rich in refrigerant and is supplied to the lower part of the absorber by a conduit 32 from the gas circulation system and the vapor space 33 of the absorber vessel 10.

The pump pipe 12 is fixed in position centrally in the outer pipe 16 by being connected at its lower part to the inner pipe 13 in the exchanger and by being fixed in the rectifier 18 by a short inner pipe 34 which, in its upper part, is connected to the pump pipe and thus forms a vapor space about the pipe and at the outside is guided by impressions 35 in the outer pipe. According to the invention the outer pipe has in its lower part a crimping 36 which extends inwardly so much that the outer pipe is in heat-conductive contact with the pump pipe 12. The crimping 36 is relatively short and situated within a lower part of the boiler in the zone in which heat is supplied.

Even if the pump pipe 12, upon start of an apparatus according to the invention, should contain absorption solution of lower concentration of refrigerant than during normal operation, the above-described design of the apparatus will cause the heat supply to be distributed to both liquid masses commencing from the beginning of the operation. Without influencing directly the concentration of refrigerant in the absorption solution in the outer pipe it is thus possible by this simple means, on one hand to achieve a quicker start-up of the apparatus, and on the other hand, to prevent creation of undesirable excess temperature in the boiler.

Under particularly difficult circumstances it may occur that the outer pipe in the boiler does not contain liquid. Consequently, the apparatus will not start if the apparatus is of the known type, and intended for heat transfer through the liquid contents of the outer pipe. Instead, the temperature will rise to an unacceptable extent. The present apparatus constructed according to the present invention prevents such an undesirable occurrence.

Although a single embodiment of the present invention is disclosed and described herein, it will be apparent that variations and modifications may be made herein which fall within the spirit and scope of the present invention as defined in the following appended claims.

What is claimed:

1. In an absorption refrigerating apparatus having a single pipe boiler construction, and that operates with inert gas in which absorption solution rich in refrigerant is lifted in a central pump pipe in which vapor is expelled and the weak solution formed therein flows downwardly in an outer pipe, at least one heat source being arranged in heat-conductive contact with the outside of said outer pipe and heat from the heat source being conducted through the weak solution in the outer pipe to the pump pipe and its contents, the improvement comprising: a first means for supplying heat directly by conduction to said outer pipe, and a deformed section of said outer pipe which engages said pump pipe and forms a second direct heat-conductive connection arranged between the outer pipe and said pump pipe.

2. The arrangement as claimed in claim 1 wherein said outer pipe of the boiler is provided with a metallic heat-conductive connection between said heat supplying means and said pump pipe.

3. The arrangement as claimed in claim 2 wherein said heat-conductive connection is located within the lower part of a zone in which heat is supplied to said absorption refrigerating apparatus.

4. The arrangement as claimed in claim 3 wherein said heat-conductive connection has a height which is less than half the height of said heat source which supplies heat to said outer pipe.

5. An arrangement as claimed in claim 3 wherein the surface of said pump pipe to which heat is supplied through said outer pipe is considerably smaller than the outer pipe which delivers heat to the solution therein.

6. An arrangement as claimed in claim 1 wherein said second heat-conductive connection is inwardly deformed.

* * * * *